US008302245B2

(12) United States Patent
Libman

(10) Patent No.: US 8,302,245 B2
(45) Date of Patent: Nov. 6, 2012

(54) RETAINER FOR MOP

(75) Inventor: Robert J. Libman, Arcola, IL (US)

(73) Assignee: The Libman Company, Arcola, IL (US)

( * ) Notice: Subject to any disclaimer, the term of this patent is extended or adjusted under 35 U.S.C. 154(b) by 769 days.

(21) Appl. No.: 11/967,349

(22) Filed: Dec. 31, 2007

(65) Prior Publication Data

US 2009/0165232 A1 Jul. 2, 2009

(51) Int. Cl.
*A47L 13/00* (2006.01)

(52) U.S. Cl. ..... 15/120.1; 15/120.2; 15/119.1; 15/119.2; 15/116.1; 15/116.2

(58) Field of Classification Search ..... 15/116.1, 15/116.2, 119.1, 119.2, 120.1, 120.2
See application file for complete search history.

(56) References Cited

U.S. PATENT DOCUMENTS

| | | | | |
|---|---|---|---|---|
| 5,060,338 | A | 10/1991 | Yates | |
| 5,819,356 | A * | 10/1998 | Cann | 15/120.1 |
| 6,880,587 | B1 * | 4/2005 | Carter et al. | 141/67 |
| 2004/0128783 | A1 | 7/2004 | Lesley | |
| 2006/0016031 | A1 | 1/2006 | Llanes | |
| 2006/0016032 | A1 | 1/2006 | Libman | |

FOREIGN PATENT DOCUMENTS

| | | |
|---|---|---|
| CN | 1032850 | 5/1989 |
| EP | 1180341 | 2/2002 |
| WO | 95/07046 | 3/1995 |
| WO | 2007/143471 | 12/2007 |

OTHER PUBLICATIONS

Office Action dated Feb. 25, 2010, from Australian Patent Application No. 2008331355 2 pages.
International Search Report for PCT/US2008/088511, dated May 4, 2009.
European Search Report dated Jun. 28, 2010, from European Patent Application No. 10 00 4914 6 pages.

* cited by examiner

*Primary Examiner* — Robert Scruggs
(74) *Attorney, Agent, or Firm* — Banner & Witcoff, Ltd.

(57) ABSTRACT

A mop with a handle includes a plurality of mop fibers coupled to the handle. The mop includes a grip mounted on the handle, and a collar that is slidably positioned on the handle. The collar can be secured to the grip when not in use. The collar may include one or more tabs with a ramp for engagement with a ridge located on the grip that, in operation, allows for detachably coupling of the collar to the grip. The ramp is configured so that it extends a sufficient distance from the tab so as to cause the tab to flex when the collar is attached to the grip. In operation, a user can uncouple the collar from the grip and slide the collar over the mop fibers and use the collar to wring the mop fibers.

16 Claims, 8 Drawing Sheets

RETAINER FOR MOP

FIELD OF THE INVENTION

The invention relates generally to mops and more specifically to self-wringing mops.

BACKGROUND OF THE INVENTION

Mops are available in two basic configurations, those that are self-wringing and those that require the use of an external wringer. While both are suitable for a wide range of uses, self-wringing mops are often preferred when cleaning smaller areas such as kitchen floors. The advantage of a self-wringing mop is that the wringer is integrated into the mop, thus avoiding the need for specialized wringing buckets and wringers and the like.

Self-wringing mops are available in a number of different configurations. One configuration is a mop that includes mop fibers on one end of a handle and a wringing cup or collar positioned on the handle. The mop fibers are placed in liquid and then the collar may be brought into contact with the mop fibers and used (e.g., rotated) to wring out the mop fibers. As can be appreciated, one advantage of such a design is the ability to have mop fibers that are similar to the mop fibers used in mops that require external wringers while still providing a self-wringing mop that may be easily stored and used. While existing designs have proven beneficial, sometimes controlling the collar is not as convenient as desired, thus further improvements in the operation of the collar would be beneficial.

BRIEF SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

A mop includes a handle with mop fibers mounted on a distal end. A grip is positioned on the handle. A collar is slidably positioned between the grip and the mop fibers. The collar is configured to engage and wring at least a portion of the mop fibers. The collar may include at least one flexible tab that is configured to engage a ridge on the grip, so as to allow the grip to support the collar when the collar is not being used to wring the mop fibers.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the disclosure.

It has been determined that while a friction fit coupling between a grip and a collar (such as two tapered sections that provide an interference fit) can be used to secure the collar to the grip, the collar will occasionally loosen due to vibration that is caused by use. This is annoying for the user because the collar drops down and obscures the mop fibers and the user must again couple the collar to the grip. Furthermore, if too much force is used to couple the collar to the grip, the user will subsequently have trouble removing the collar from the grip. It is believed that this is because the kinetic friction resisting the insertion of the collar into the grip is less than the subsequent static friction resisting removal of the collar from the grip when the user attempts to detach the collar from the grip. The fact that the surface of the collar may be wet or dirty further complicates these issues. In addition, it has been determined that manufacturing tolerances further exasperate the use of an interference fit to hold the collar to the grip when the collar is not being used.

Figure 1:
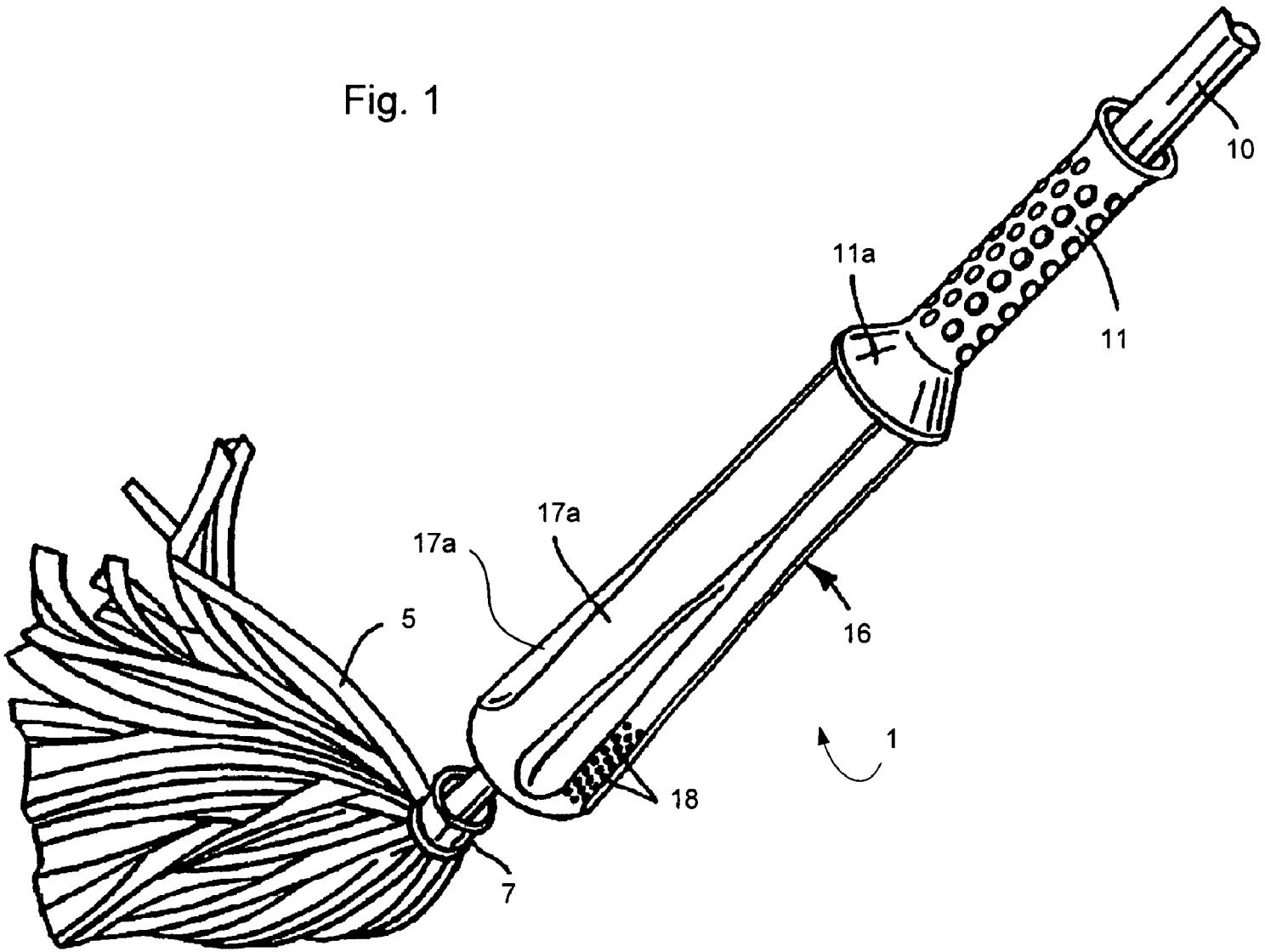
FIG. 1 illustrates a partial isometric view of an embodiment of a self-wringing mop.
Figure 2:
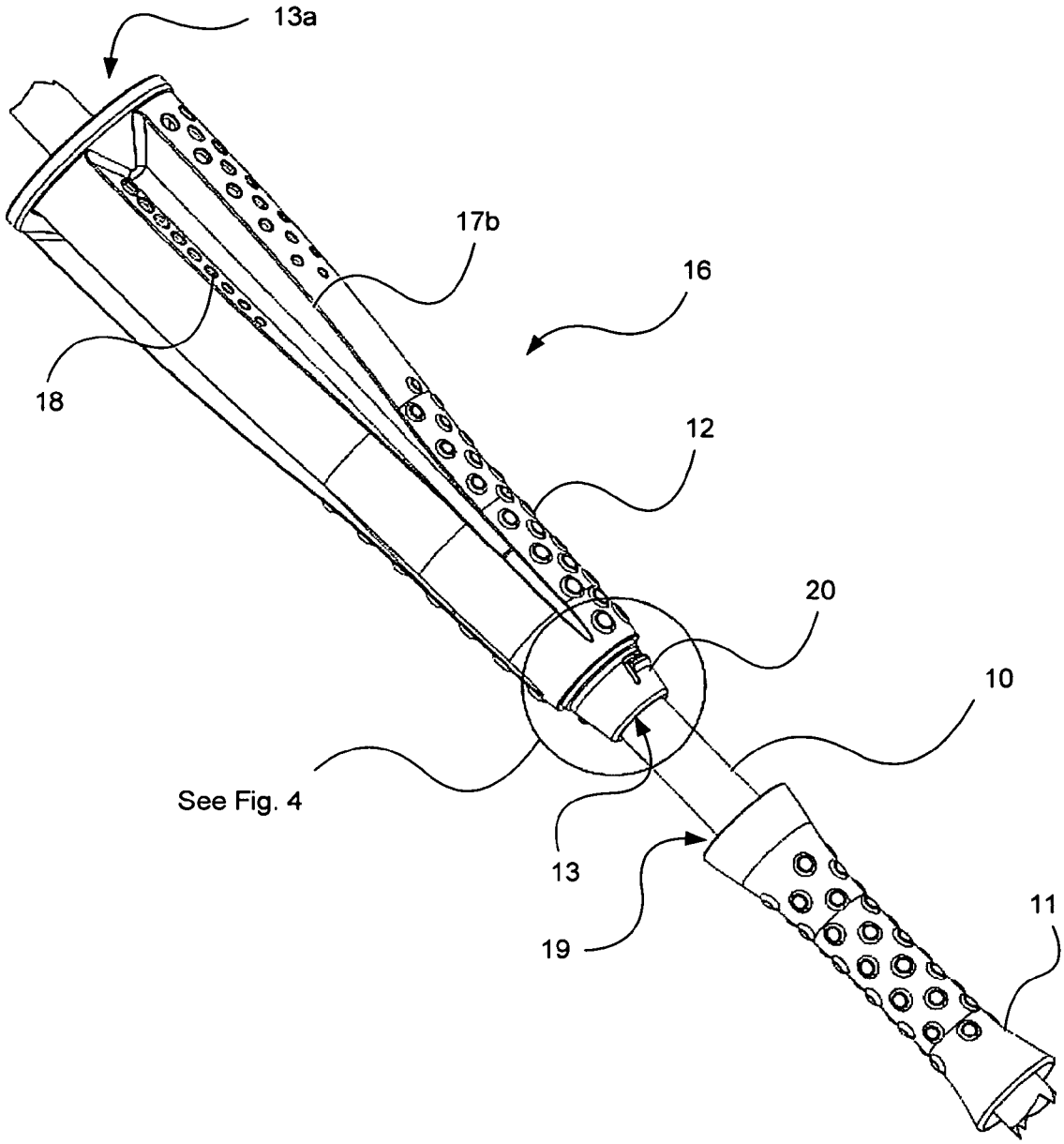
FIG. 2 illustrates an isometric view of an embodiment of a collar configured to couple to a grip.
Figure 3:
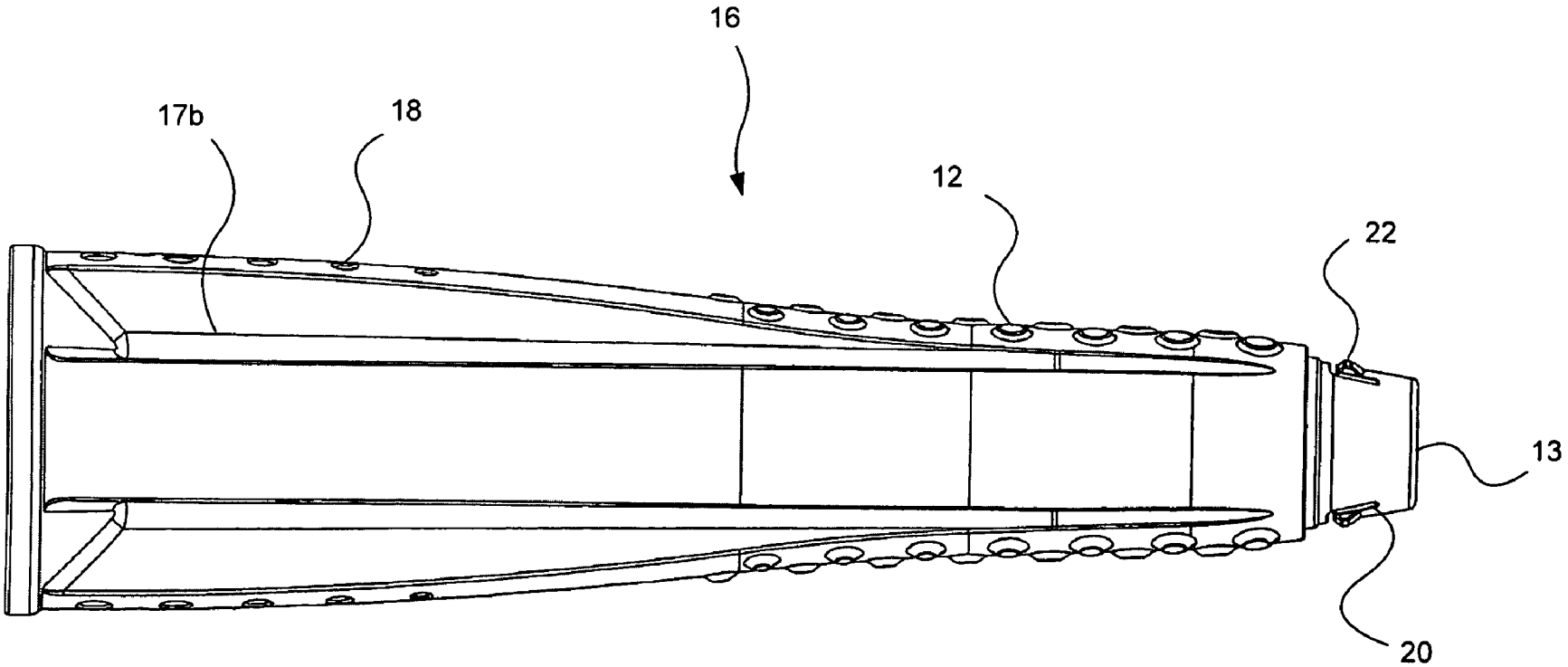
FIG. 3 illustrates a front view of an embodiment of the collar depicted in FIG. 2.
Figure 4:
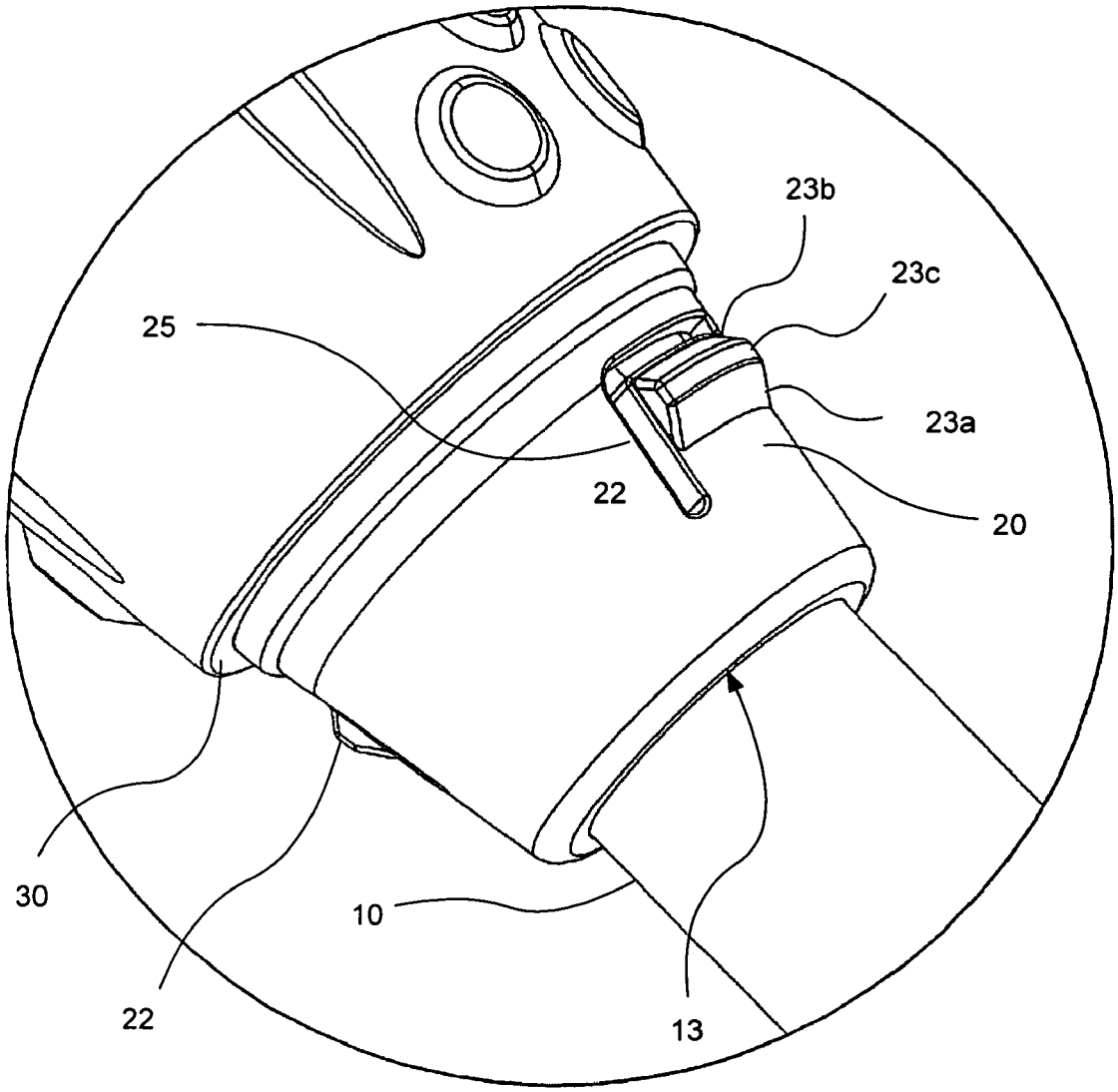
FIG. 4 illustrates an enlarged view of the callout shown in FIG. 2.
Figure 5:
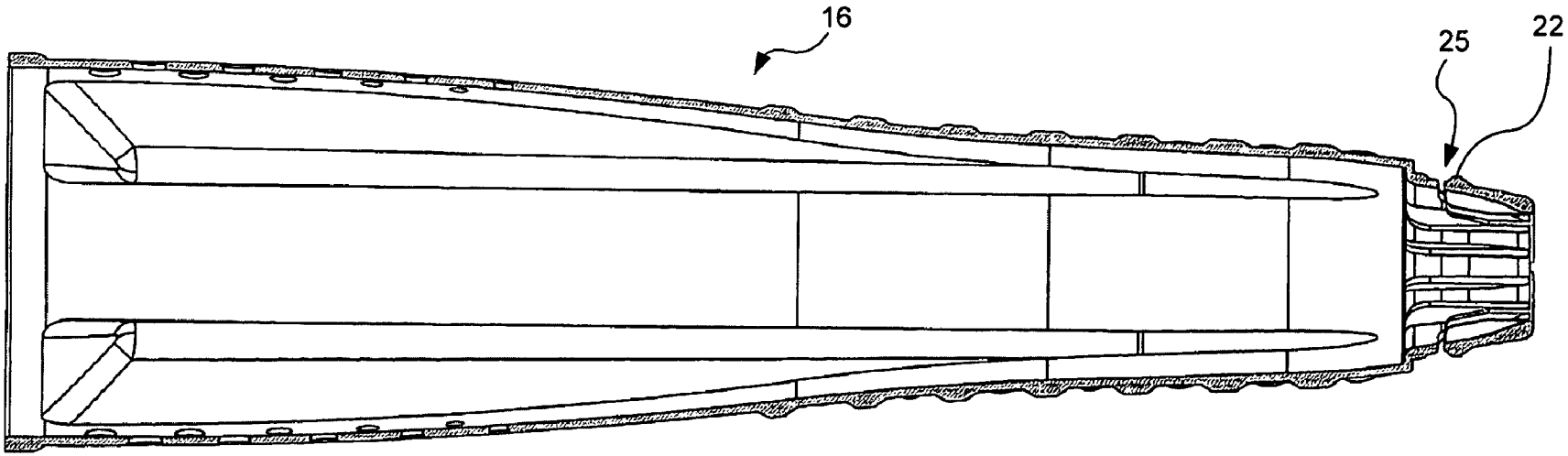
FIG. 5 illustrates a cross-section of the collar depicted in FIG. 3.
Figure 6:
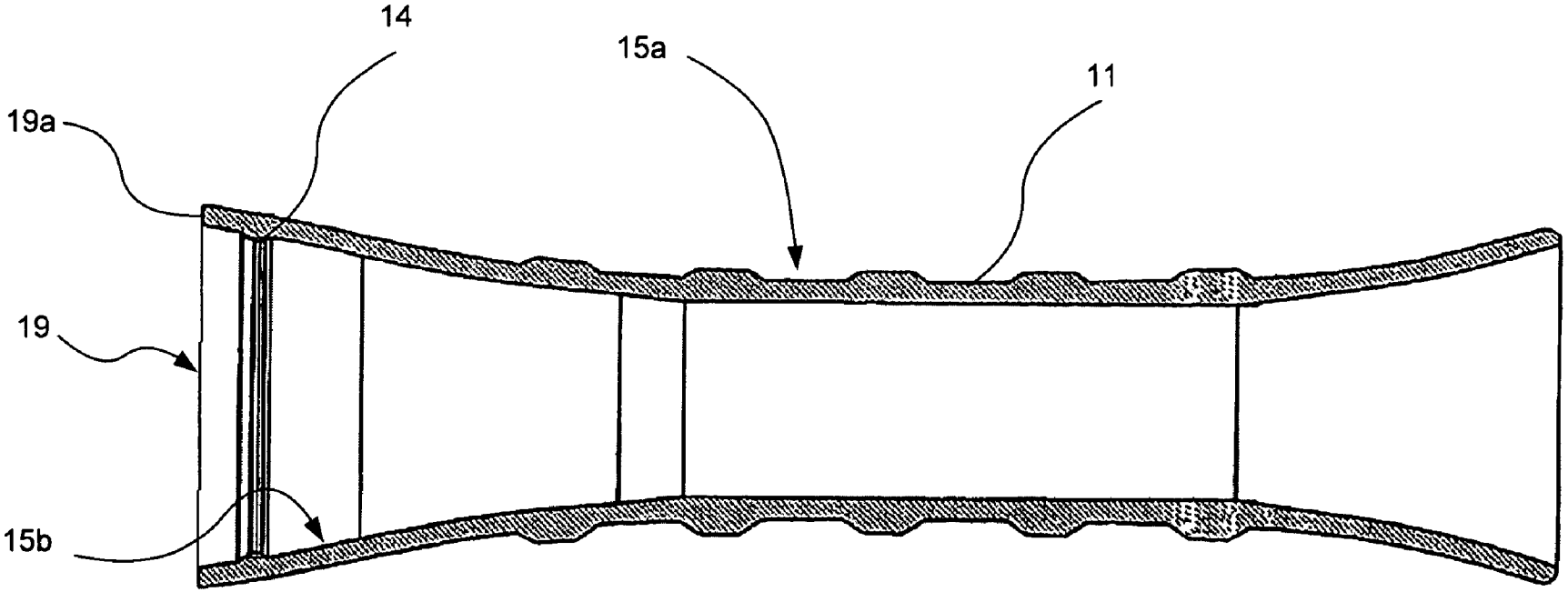
FIG. 6 illustrates a cross-section of the grip depicted in FIG. 2.
Figure 7:
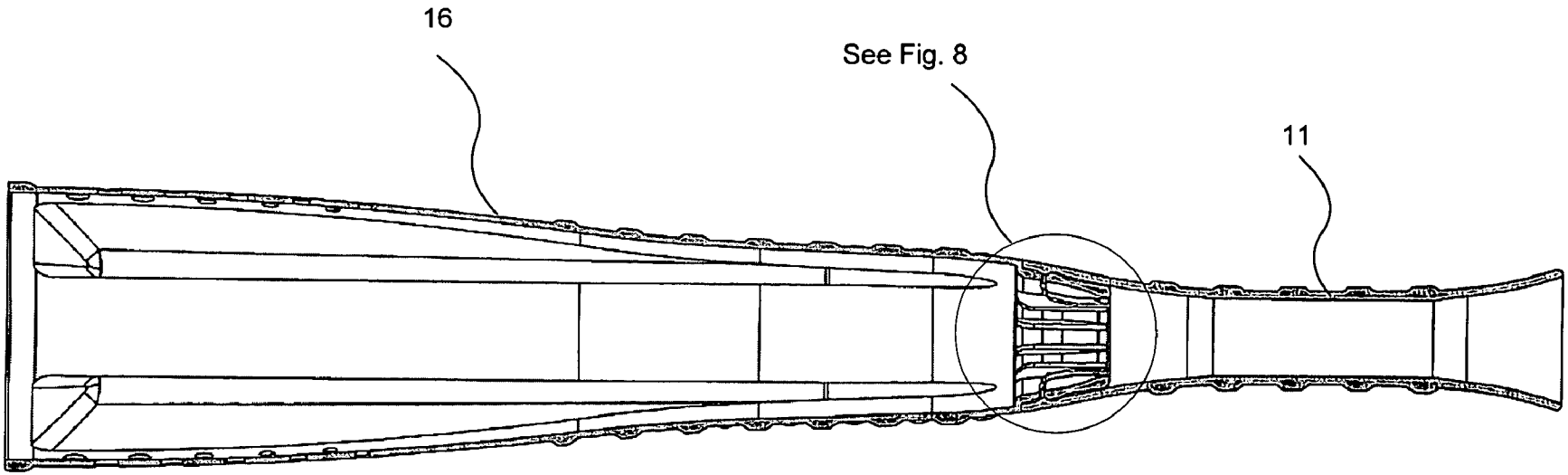
FIG. 7 illustrates a cross-section of an embodiment of a grip and collar coupled together.
Figure 8:
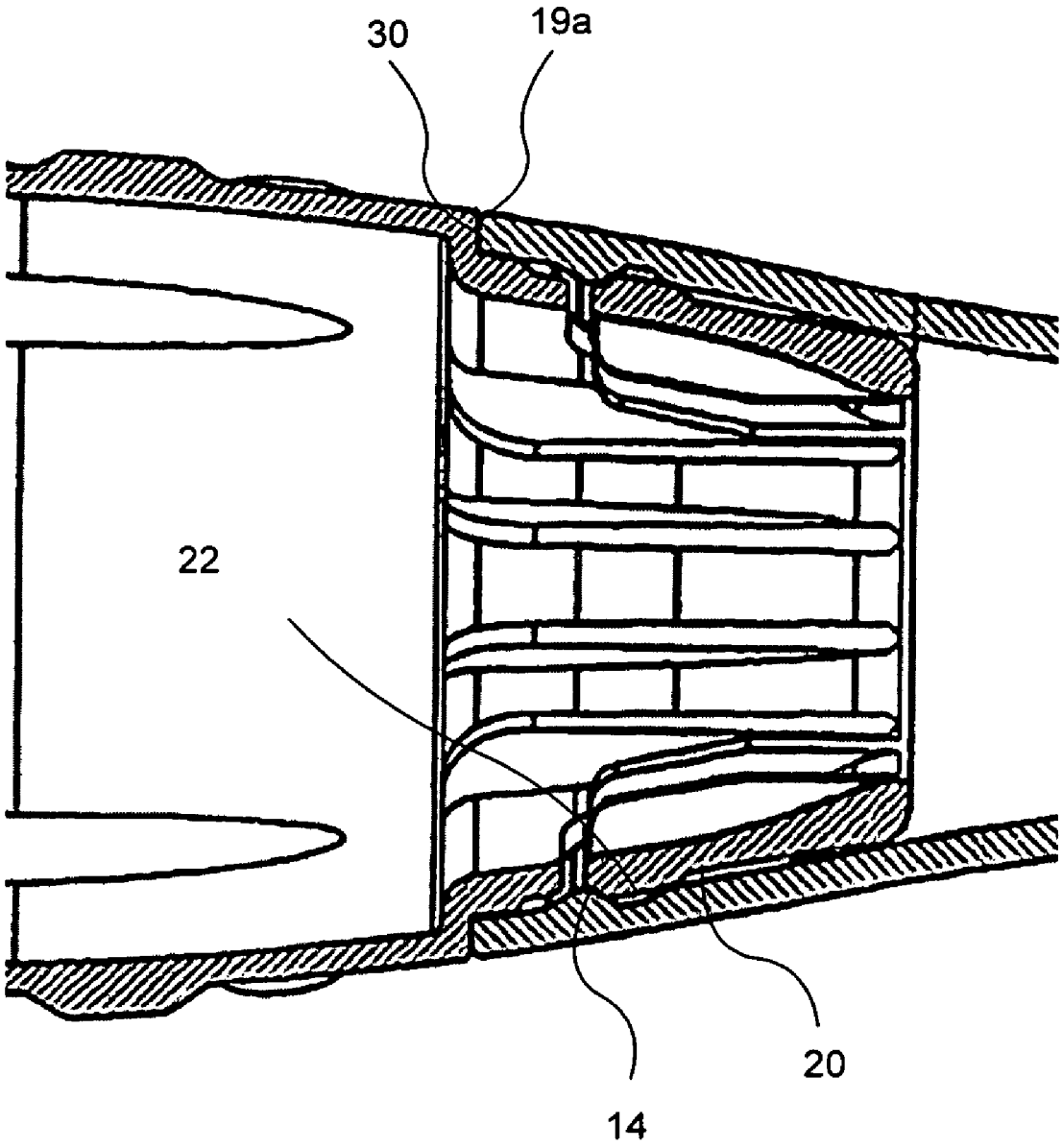
FIG. 8 illustrates an enlarged view of the callout shown in FIG. 7.

Turning to FIGS. 1-8, embodiments of a mop are depicted. As shown, mop 1 includes mop fibers 5 coupled by a connector 7 to a handle 10. Handle 10 can be made out of any suitable material, such as metal, plastic and wood and may include a circular cross-section. A grip 11 is shown mounted to the handle and coupled to the grip 11 is a collar 16. In an embodiment, the grip 11 may include a flared section 11*a* to accept the collar 16. The collar 16 includes an outer shell 17*a* with grooves 17*b* and the grooves 17*b* include one or more apertures 18. In operation, the collar 16 may be detached from the grip 11 and moved so as to at least partially cover the mop fibers 5. In an embodiment, the collar 16 may be rotated with respect to the grip 11 so as cause the grooves 17*b* to press on and wring out the mop fibers 5. Once the mop fibers 5 are wrung, the collar 16 may be attached to the grip 11 again and the mop 1 may be used in a conventional manner.

The grip 11 has gripping nodules 12 on an exterior surface 15*a* and a receiving end 19 and the grip 11 is mounted on the handle 10 such that the receiving end 19 faces toward the mop fibers 5. As shown, the collar 16 has gripping nodules 12 and both an engagement end 13, which faces the grip 11, and an enlarged collar end 13*a* that faces the mop fibers 5. The collar 16 is slidably mounted on the handle 10 between the mop fibers 5 and grip 11. It should be noted that the collar 16 and grip 11 may be made out of any desired material, such as plastic, in a conventional manner. As depicted, engagement end 13 is configured such that it faces toward the receiving end 19 of grip 11 and may be inserted into the receiving end 19 of grip 11. The enlarged collar end 13*a* is configured such that collar 16 can engage mop fibers 5 during wringing.

As can be appreciated from the figures, the engagement end 13 may be tapered to facilitate the insertion of collar 16 into grip 11. It should be noted however, that a tapered configuration is not required. The engagement end 13 of collar 16 is shown with two tabs 20 that are positioned on the engagement end 13 opposite each other. The benefit of locating two tabs 20 opposite of each other is that both tabs 20 can flex simultaneously in a manner discussed below, thus helping to even out the force required to cause the tabs to flex when attempting to attach or detach the collar 16 from the grip 11. It should be noted that some other number of tabs 20 may be used, such as one tab or three or more tabs, depending on the configuration of the tabs and the material properties of the material used to form the tab 20. The tabs 20 each include a ramp 22. In an embodiment, the ramp 22 may include a first angled surface 23*a*, a second angled surface 23*b*, and a top surface 23*c*.

In an embodiment, the tab 20 may be integrally formed in the collar 16 and thus the collar 16 may include a substantially U-shaped gap 25 in the engagement end 13 surrounding the tab 20. As can be appreciated, this allows the tab to be formed in a more economical manner.

As depicted, the grip 11 includes a ridge 14 that is located on interior surface 15*b* of grip 11 near the receiving end 19. Further, ridge 14 may be annular such that ridge 14 is configured to engage ramp 22 over a 360 degree range of orientation. This provides the advantage of avoiding the need for a particular orientation of the collar 16 when the collar and grip 14 are being coupled together.

In an embodiment, the collar 16 can be translated along handle 10 such that engagement end 13 of collar 16 engages receiving end 19 of grip 11. In operation, therefore, a user can slide the collar 16 toward the grip 11 and insert the engagement end 13 of collar 16 into the receiving end 19 of grip 11.

As depicted, both the collar 16 and grip 11 are configured such that when the engagement end 13 enters the receiving end 19, the first angled surface 23*a* of ramp 22 contacts the ridge 14. As first angled surface 23*a* slides along ridge 14, tab 20 begins to flex from a first position. As the engagement end 13 of the collar 16 is inserted further into the receiving end 19, the top surface 23*c* contacts ridge 14. At this point, the tab 20 is a second position. Further insertion of the engagement end 13 causes the second angled surface 22*b* to engage the ridge 14 as the tab 20 begins to translate back toward the first position. As the natural resting position of the tab 20 is closer to the first position, the tab is biased away from the second position toward the first position. While the top surface 22*c* may be omitted, its inclusion adds material to the ramp 22 and thus tends to increase the durability of the ramp 22. It should be noted that in an alternative embodiment, the engagement end and the receiving end can be modified so that tab and ridge mounted on opposite sides. Thus, unless otherwise noted, the depicted configuration is not intended to be limiting.

Because of the tapered shape of the engagement end 13 and the receiving end 19, further insertion of the engagement end 13 would normally cause the receiving end 19 and the engagement end 13 to frictionally engage so as to prevent the collar 16 from dropping down. As can be appreciated, because of biased nature of the tab 20, the ramp 22 on the tab 20 will act to prevent the engagement end 13 from becoming disengaged due to vibrations. However, there is still the possibility that the frictional engagement would cause the collar 16 to stick to the grip 11 and inhibit removal of the collar 16 from the grip 11. Therefore, a shoulder 30 on the engagement end 13 may be provided for mating with edge 19*a* of the receiving end 19. In operation, the edge 19*a* will come into contact with the shoulder 30 and prevent further insertion of the engagement end 13 into the receiving end 19. Thus, in an embodiment, the shoulder 30 and edge 19*a* will prevent the grip 11 and collar 16 from becoming wedged together while the tab 20 with the ramp 22 will prevent the collar 16 from becoming inadvertently detached from the grip 11.

To uncouple collar 16 from grip 11, a user translates collar 16 toward the mop fibers 5. In operation, the ridge 14 contacts the second angled surface 23*b* and as second angled surface 23*b* slides along the ridge 14, the tab 20 begins to flex in a manner that is substantially the opposite of the insertion of the engagement end 13, discussed above. It should be noted that while other angles are possible, an angle of about 45 degrees on the first and second surface of the ramp will be suitable in providing sufficient force to secure the collar to the grip 11 while still allowing for ease of installation and removal. Thus, in an embodiment, the first and second surface 22*a*, 22*b* will be about 90 degrees apart. Naturally, a range of angle will work and the surfaces of the ramp 22 need not be linear.

In operation, if the user wishes to wring out the mop fibers 5, the user can slide collar 16 toward the mop fibers 5. As the collar 16 is translated toward the mop fibers, an enlarged collar end 13*a* contacts mop fibers 5 and begins to slide over them. As the enlarged collar end 13*a* slides over the mop fibers 5, mop fibers 5 enter the collar 16 and come into contact with one or more groves 17*b*. The grove(s) 17*b* compresses the mop fibers 5 and causes fluids and particles to be expelled through apertures 18 in the grove. As can be appreciated, additional fluid and particles may also exit out of the enlarged end 13*a*. Once the mop fibers 5 are wrung, the collar 16 may be coupled to the grip 11 as discussed above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A mop, comprising:

a handle;

a plurality of mop fibers coupled to the handle;

a grip mounted on the handle, the grip including a receiving end facing the mop fibers, the receiving end including an interior surface with a ridge positioned on the interior surface; and a collar slidably positioned on the handle, the collar including an engagement end configured to be inserted into the receiving end of the grip so as to engage the grip, the engagement end including a tab supporting a ramp, wherein said tab and said ramp are located spaced apart from an upper edge of the engagement end and extend radially outward from an exterior surface of the collar and axially downward from the collar toward the plurality of mop fibers, wherein the ramp has a height sufficient to cause the tab to flex inwardly when the ramp engages the ridge on the interior surface of the grip as the collar is inserted into the grip, the ramp configured to assist in preventing the collar from becoming detached from the grip by pressing on the ridge, the ramp configured, in operation, to cause the tab to translate from a first position to a second position and back toward the first position, within a gap located on the collar spaced apart from an upper edge of the engagement end, when the collar is inserted into the grip.

2. The mop of claim 1, wherein the collar includes a plurality of grooves configured to engage the mop fibers, each of the plurality of grooves including a plurality of apertures.

3. The mop of claim 2, wherein the grip includes a first plurality of gripping nodules and the collar includes a second plurality of gripping nodules.

4. The mop of claim 1, wherein the ramp includes a first angled surface and a second angled surface, the first angled surface and second angled surface being about 90 degrees apart.

5. The mop of claim 4, wherein the first and second angled surface are separated by a top surface.

6. The mop of claim 5, wherein the ridge extends continuously around the interior surface of the grip, wherein the ridge is configured to engage the ramp over a 360 degree range of orientation.

7. The mop of claim 1, wherein the tab is a first tab, the collar further comprising a second tab, the first tab and second tab being positioned opposite each other.

8. The mop of claim 1, wherein the gap is formed U-shaped in the engagement end of the collar.

9. The mop of claim 1, wherein the collar includes a shoulder and the grip includes an edge configured to mate with the shoulder, wherein, in operation the shoulder and grip act to prevent further insertion of the collar into the grip.

10. A mop, comprising:

a handle;

a plurality of mop fibers mounted to the handle;

a grip mounted on the handle, the grip including a receiving end that faces the plurality of mop fibers;

a collar slidably positioned on the handle and configured, in operation, to wring the plurality of mop fibers, wherein the collar includes an engagement end configured to engage the receiving end of the grip, the collar configured to be removably coupled to the grip;

an annular ridge positioned on one of the grip and the collar; and a tab with a first surface that supports a ramp, the tab positioned on the other of the grip and the collar, wherein said tab and said ramp are located spaced apart from an edge of the receiving end of the grip or the engagement end of the collar and extend radially outward from an exterior surface of the grip or the collar and extend axially downward toward the plurality of mop fibers, the tab configured to flex, in operation, when the collar engages the grip, wherein the ramp extends a sufficient distance away from the first surface so as to cause the tab to translate radially inward when the ramp is slid past the ridge during engagement of the collar and the grip.

11. The mop of claim 10, wherein the receiving end of the grip includes an interior surface and an exterior surface and the ridge is positioned on the interior surface, wherein the exterior surface includes a plurality of gripping nodules.

12. The mop of claim 11, wherein the tab is positioned on the collar and the tab is a first tab with a first ramp and the collar further comprises a second tab positioned opposite the first tab, the second tab including a second ramp, wherein the first and second ramp are configured to respectively cause the first and second tab to flex when the collar is mounted to the grip.

13. The mop of claim 12, wherein the receiving end of the grip is flared so as to allow the engagement end of the collar to be inserted into the receiving end of the grip.

14. The mop of claim 10, wherein a shoulder is positioned adjacent the tab and an edge positioned proximate the ridge is configured to engage the shoulder.

15. A method of wringing a mop, comprising:

sliding a collar along a handle until the collar at least partially covers a plurality of mop fibers;

wringing the mop fibers with the collar, the collar including a plurality of grooves with apertures, the grooves configured to squeeze the mop fibers;

sliding the collar along the handle until the collar engages a grip mounted on the handle; and inserting an engagement end of the collar into a receiving end of the grip, the inserting causing a plurality of tabs with ramps to translate from a first position as the ramps slide over an annular ridge positioned on an interior of the receiving end of the grip wherein a corresponding U-shaped gap surrounds each tab and the tabs extend radially outward from an exterior surface of the collar and axially downward toward the plurality of mop fibers.

16. The method of claim 15, wherein the inserting causes the plurality of tabs translate back to the first position once the ramp slides past the annular ridge.

* * * * *